US008092967B2

(12) United States Patent
Shimmura

(10) Patent No.: US 8,092,967 B2
(45) **Date of Patent: *Jan. 10, 2012**

(54) DEVELOPING AGENT

(75) Inventor: Shoko Shimmura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/010,321

(22) Filed: Jan. 20, 2011

(65) Prior Publication Data

US 2011/0116839 A1 May 19, 2011

Related U.S. Application Data

(63) Continuation of application No. 12/684,444, filed on Jan. 8, 2010, now abandoned, which is a continuation of application No. 11/812,707, filed on Jun. 21, 2007, now Pat. No. 7,684,737, which is a continuation of application No. 11/156,632, filed on Jun. 21, 2005, now Pat. No. 7,236,724.

(51) Int. Cl.
*G03G 9/00* (2006.01)

(52) U.S. Cl. ..... 430/109.4; 430/110.3; 430/111.4; 399/222; 399/223; 399/252

(58) Field of Classification Search ..... 430/109.4, 430/110.3, 111.4; 399/222, 223, 252
See application file for complete search history.

(56) References Cited

U.S. PATENT DOCUMENTS

| | | | |
|---|---|---|---|
| 6,493,009 | B1 | 12/2002 | Mukai et al. |
| 6,952,546 | B2 | 10/2005 | Yoshikawa |
| 7,160,663 | B2 | 1/2007 | Komoto et al. |
| 7,171,151 | B2 | 1/2007 | Endo et al. |
| 7,209,684 | B2 | 4/2007 | Shimmura et al. |
| 7,236,724 | B2 | 6/2007 | Shimmura |
| 7,684,737 | B2 | 3/2010 | Shimmura |

FOREIGN PATENT DOCUMENTS

| | | | |
|---|---|---|---|
| CN | 1497367 | A | 5/2004 |
| JP | 61-219055 | A | 9/1986 |
| JP | 06-167825 | A | 6/1994 |
| JP | 08-179570 | A | 7/1996 |
| JP | 09-073188 | A | 3/1997 |
| JP | 2000-347442 | A | 12/2000 |
| JP | 2001-318485 | A | 11/2001 |
| JP | 2002-006560 | A | 1/2002 |
| JP | 2002-328484 | A | 11/2002 |
| JP | 2002-351154 | A | 12/2002 |
| JP | 2004-037784 | A | 2/2004 |
| JP | 2004-101753 | A | 4/2004 |
| JP | 2004-117906 | A | 4/2004 |
| JP | 2004-233407 | A | 8/2004 |
| JP | 2005-099878 | A | 4/2005 |

*Primary Examiner* — Mark Chapman
(74) *Attorney, Agent, or Firm* — Foley & Lardner LLP

(57) ABSTRACT

The developing agent is selected to have a distribution of adhesive force to the surface of an image carrier, which is configured such that the ratio of the developing agent having an adhesive force which is not less than 2.5 times as high as an average value of a distribution of adhesive force is 3% by weight or less based on an entire weight of the developing agent.

10 Claims, 7 Drawing Sheets

DEVELOPING AGENT

CROSS-REFERENCE TO RELATED PATENT APPLICATIONS

This application is a Continuation of U.S. application Ser. No. 12/684,444, filed Jan. 8, 2010, which is a Continuation of U.S. application Ser. No. 11/812,707, filed Jun. 21, 2007, now U.S. Pat. No. 7,684,737, which is a Continuation of U.S. application Ser. No. 11/156,632, filed Jun. 21, 2005, now U.S. Pat. No. 7,236,724, incorporated herein by reference in there entireties.

BACKGROUND OF THE INVENTION

This invention relates to an image forming apparatus for developing an electrostatic image or a magnetic latent image in an electrophotographic method, an electrostatic printing method, or a magnetic recording method, and also to a method for forming an image where the image forming apparatus is employed.

When an image is to be formed by means of an electrophotographic system and if a two-component dry developing method is to be employed, a particulate toner is delivered from a developing apparatus and transferred via a carrier, an image carrier and, optionally, a transfer medium such as in intermediate transferring member, etc., to a recording material. Then, the toner on the recording material is subjected to heat and pressure so as to be fixed on the recording material. The toner in this case is enabled to adhere to each transferring medium through electrostatic force derived from the quantity of electric charge each toner particle has, van der Waals force, and liquid cross-linking force, i.e., adhesive force effected by water or moisture. The toner is transferred mainly through the mechanism that toner once adhered to one of the transferring medium is separated by the effect of external electric field and then permitted to adhere to a succeeding transferring medium. The toner is ultimately transferred over a recording medium such as paper and fixed as a pattern on the recording medium to form an image thereon. In order to efficiently transfer the toner to obtain a final image of high quality, it is desirable to control the adhesive force of toner to the transferring mediums.

As for the method of forming an image through the control of adhesive force of toner, there has been proposed a method of forming an image as shown in Japanese Laid-open Patent Publication (Kokai) No. 2002-328484 wherein the relationship among the adhesive force between the toner and an image carrier, an average particle size of toner, and the quantity of electrification is confined. In this case, there has been proposed a method of calculating the aforementioned adhesive force from the centrifugal force which is required to separate the toner from a transferring medium and which can be derived through the employment of a centrifugal separator.

Alternatively, Japanese Laid-open Patent Publication (Kokai) No. 2004-101753, for example, describes a method of improving the transferring properties of toner wherein the toner is regulated to meet the condition of $F/2\sigma>10$ as the toner is subjected to centrifugal separation (wherein F is an average value in the distribution of toner adhesive force to be obtained from the measurement of adhesive force of toner after the tone is pressed onto the surface of an image carrier at a predetermine pressure; and $\sigma$ is a standard deviation). In this method, it is intended that the distribution of toner adhesive force to be measured under specific conditions is greatly sharpened thereby to suppress non-uniformity of the transferring properties of toner and to make it possible to perform the transferring of toner efficiently and very precisely.

However, since this distribution of toner adhesive force is confined to an extremely narrow range, e.g. the a standard deviation $\sigma$ is required to be not more than $0.3\times10^{-8}$ as the average adhesive force is $6\times10^{-8}$ N, the manufacture of toner becomes very difficult. Further, although it may be possible to enlarge the distribution of toner adhesive force to a certain extent by increasing the average adhesive force, if the toner adhesive force is increased too high, the transferring electric field required for the transfer of toner would become very high, thereby giving rise to risk of aerial discharge. Further, according to this measuring method, it is required to employ a step of pressing toner onto a recording material prior to the measurement of the adhesive force in order to reproduce the transferring pressure. According to this measuring method however, it is impossible to grasp the behavior of the toner which is weak in adhesive force, i.e., the toner which can be separated from an image carrier as the toner is subjected to weak transferring electric field immediately before the toner is introduced into the transferring nip. Moreover, according to this technique, there are possibilities that a small quantity of toner particle exhibiting an adhesive force which differs greatly from the average adhesive force may be included in the toner. Toner particle exhibiting considerably large adhesive force may become a cause for generating residual toner after the step of transferring the toner. On the other hand, toner particle exhibiting considerably small adhesive force may become a cause for generating the scattering of toner to a periphery of image. Because of these reasons, even with the employment of this technique, there are problems with regard to the transferring efficiency and quality of image.

In the cleaner-less process where a mechanism for recovering residual toner concurrent with the development of image, when the toner is caused to leave behind after the transferring step thereof, the succeeding electrification step and latent image-forming step are permitted to be undergone without the residual toner being removed, after which the residual toner in the non-imaging regions is recovered by a developing device concurrent with the development of new image regions. Therefore, if the quantity of residual toner after the transferring step is large, it may become causes for generating a defective image due to the incidents that the light source for forming a latent image may be obstructed, the recovery of toner by the developing device may become insufficient, and the generation of undesirable retransferring.

In the case of a color image forming apparatus of tandem structure, the toner that has been transferred to an intermediate transferring medium for example from an image carrier may happen to be reversely transferred to an image carrier of succeeding stage when the toner is subjected to a transferring electric field in the transferring region of the image carrier of succeeding stage and, at the same time, is press-contacted with the succeeding image carrier. Once this reversely transferred toner is recovered by the developing device in the cleaner-less process, the toner having the color of the developing station of the preceding stage is permitted to enter into the developing device of the succeeding stage, thereby making it impossible to perform the management of color if the toner entering the developing device of the succeeding stage is increased. The transferring efficiency frequently conflicts in nature with the reverse transferring efficiency. Therefore, in order to prevent such a situation where the color mixing due to the reverse transferring become too prominent to recover, it is required to adopt transferring conditions which make it possible to prevent the reverse transferring even at the sacrifice, to a certain extent, of the transferring performance.

BRIEF SUMMARY OF THE INVENTION

An object of the present invention is to provide an image forming apparatus which is excellent in transferring efficiency, is applicable even to a cleaner-less process, and is capable of forming a highly precise image which is substantially free from dusts.

Another object of the present invention is to provide a method of forming an image, which is excellent in transferring efficiency, is applicable even to a cleaner-less process, and makes it possible to form a highly precise image which is substantially free from dust.

The image forming apparatus according to a first aspect of the present invention comprises an image carrier, a developing portion for feeding particles of developing agent (or developing particle) to an electrostatic latent image to enable the developing agent to adhere to the surface of an image carrier to thereby form a developing agent image, and a transferring portion for transferring the developing agent image to a recording material; wherein the developing agent is selected to have a distribution of adhesive force to the surface of the image carrier, which is configured such that the ratio of the developing agent having an adhesive force which is not less than 2.5 times as high as an average value of a distribution of adhesive force is 3% by weight or less based on an entire weight of the developing agent.

The image forming apparatus according to a second aspect of the present invention comprises an image carrier, a developing portion for feeding particles of developing agent to an electrostatic latent image to enable the developing agent to adhere to the surface of an image carrier to thereby form a developing agent image, and a transferring portion for transferring the developing agent image to a recording material; wherein the developing portion is provided with a mechanism for recovering a residual toner remaining on the surface of the image carrier concurrent with the development of image; and the developing agent is selected to have a distribution of adhesive force to the surface of the image carrier, which is configured such that the ratio of the developing agent having an adhesive force which is not less than 2.5 times as high as an average value of a distribution of adhesive force is 1.5% by weight or less based on an entire weight of the developing agent.

The image forming apparatus according to a third aspect of the present invention comprises an image carrier, a developing portion for feeding particles of developing agent to an electrostatic latent image formed on the image carrier to enable the developing agent to adhere to the surface of an image carrier to thereby form a developing agent image, and a transferring portion for transferring the developing agent image to a recording material; wherein the developing agent is selected to have a distribution of adhesive force to the surface of the image carrier, which is configured such that the ratio of the developing agent having an adhesive force of not more than 20% of an average value of a distribution of adhesive force is 10% by weight or less based on an entire weight of the developing agent.

The color image forming apparatus according to a fourth aspect of the present invention comprises image carriers, two or more developing portions for feeding plural kinds, differing in color, of developing agent to electrostatic latent images formed on the image carriers respectively to enable the developing agent to adhere to the surface of each of image carriers to thereby form developing agent images differing in color, and transferring portions for transferring the developing agent images differing in color to a recording material; wherein each of the developing agents is selected to have a distribution of adhesive force to the surface of the image carrier, which is configured such that the ratio of the developing agent having an adhesive force of not more than 20% of an average value of a distribution of adhesive force is 5% by weight or less based on an entire weight of the developing agent.

The method of forming an image according to a fifth aspect of the present invention comprises the steps of: developing a developing agent image on an image carrier by feeding particles of developing agent accommodated in a developing portion to an electrostatic latent image to enable the developing agent to adhere to the surface of an image carrier, and transferring the developing agent image to a recording material; wherein the developing agent is selected to have a distribution of adhesive force to the surface of the image carrier, which is configured such that the ratio of the developing agent having an adhesive force which is not less than 2.5 times as high as an average value of a distribution of adhesive force is 3% by weight or less based on an entire weight of the developing agent.

The method of forming an image according to a sixth aspect of the present invention comprises the steps of: developing a developing agent image on an image carrier by feeding particles of developing agent accommodated in a developing portion to an electrostatic latent image to enable the developing agent to adhere to the surface of an image carrier, and transferring the developing agent image to a recording material; wherein the developing step is performed in a manner that a residual toner or developing agent remaining on the surface of the image carrier is recovered concurrent with the development of image; and the developing agent is selected to have a distribution of adhesive force to the surface of the image carrier, which is configured such that the ratio of the developing agent having an adhesive force which is not less than 2.5 times as high as an average value of a distribution of adhesive force is 1.5% by weight or less based on an entire weight of the developing agent.

The method of forming an image according to a seventh aspect of the present invention comprises the steps of: developing a developing agent image on an image carrier by feeding particles of developing agent accommodated in a developing portion to an electrostatic latent image to enable the developing agent to adhere to the surface of an image carrier; wherein the developing agent is selected to have a distribution of adhesive force to the surface of the image carrier, which is configured such that the ratio of the developing agent having an adhesive force of not more than 20% of an average value of a distribution of adhesive force is 10% by weight or less based on an entire weight of the developing agent.

The method of forming a color image according to an eighth aspect of the present invention comprises: two or more steps of developing images of developing agents differing in color by feeding developing agents from two or more developing portions to electrostatic latent images, respectively, formed on the image carriers to enable the developing agent to adhere to the surface of each of image carriers to thereby form developing agent images differing in color, steps of transferring the developing agent images differing in color to a recording material, and steps of fixing the images of transferred developing agents on the recording material; wherein each of the developing agents is selected to have a distribution of adhesive force to the surface of the image carrier, which is configured such that the ratio of the developing agent having an adhesive force of not more than 20% of an average value of a distribution of adhesive force is 5% by weight or less based on an entire weight of the developing agent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
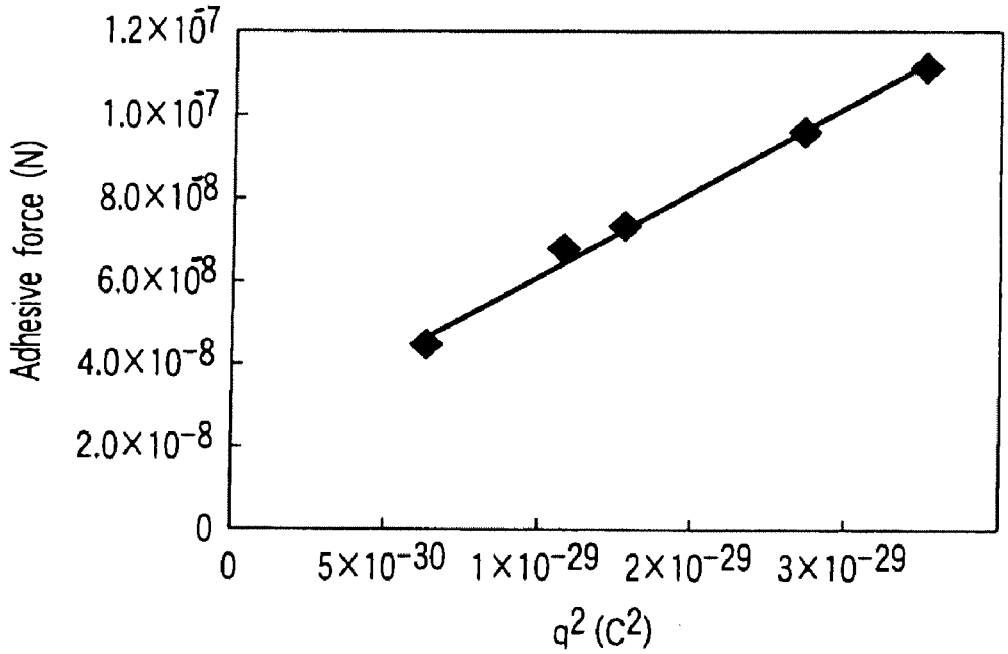
FIG. 1 is a graph illustrating one example of the relationship between the quantity of electric charge of toner and the adhesive force of toner.

The present invention can be classified into the following eight aspects.

The image forming apparatus according to the present invention fundamentally comprises an image carrier, a developing portion for feeding particles of developing agent to an electrostatic latent image to enable the developing agent to adhere to the surface of an image carrier to thereby form a developing agent image, and a transferring portion for transferring the developing agent image to a recording material, wherein the non-uniformity in adhesive force between each of the developing agent to be employed and the surface of image carrier is regulated according to the following first to fourth distribution of adhesive force.

Further, the method of forming an image according to the present invention fundamentally comprises the steps of: developing a developing agent image on an image carrier by feeding particles of developing agent accommodated in a developing portion to an electrostatic latent image to enable the developing agent to adhere to the surface of an image carrier, and transferring the developing agent image to a recording material; wherein the non-uniformity in adhesive force between each of the developing agent to be employed and the surface of image carrier is regulated according to the following first to fourth distribution of adhesive force.

The first distribution of adhesive force is regulated such that a distribution of adhesive force of the developing agent to the surface of the image carrier is configured such that the ratio of the developing agent having an adhesive force which is not less than 2.5 times as high as an average value of a distribution of adhesive force is 3% by weight or less based on an entire weight of the developing agent.

The second distribution of adhesive force is made applicable to a case where the developing portion is further provided with a mechanism for recovering a residual toner adhered to the surface of the image carrier concurrent with the development of image and is regulated such that a distribution of adhesive force of the developing agent to the surface of the image carrier is configured that the ratio of the developing agent having an adhesive force which is not less than 2.5 times as high as an average value of a distribution of adhesive force is 1.5% by weight or less based on an entire weight of the developing agent.

The third distribution of adhesive force is regulated such that a distribution of adhesive force of the developing agent to the surface of the image carrier is configured such that the ratio of the developing agent having an adhesive force of not more than 20% of an average value of a distribution of adhesive force is 10% by weight or less based on an entire weight of the developing agent.

The fourth distribution of adhesive force is made applicable to the formation of a color image and is regulated such that a distribution of adhesive force of the developing agent to the surface of the image carrier is configured that the ratio of the developing agent having an adhesive force of not more than 20% of an average value of a distribution of adhesive force is 5% by weight or less based on an entire weight of the developing agent.

With respect to the image forming apparatus and the method of forming an image where the first distribution of adhesive force is applied thereto, the present inventors have found out through experiments that there is an interrelationship between the ratio of developing agent having an adhesive force which is not less than 2.5 times as high as an average value of a distribution of adhesive force and the quantity of residual toner left remain on the surface of image carrier after the transferring step of image.

In the formation of an image in this case, it is possible to employ a cleaning device provided with a blade made of rubber for example for the recovery of residual toner after the transferring step of image.

Further, in the formation of an image in this case, it is possible to employ a cleaning device having, for example, a recycle mechanism for returning residual toner to a developing device and to a toner hopper.

When the aforementioned cleaning devices are provided over the image carrier, it is possible to obtain an image which is free from any problem in quality thereof even if the quantity of residual toner is increased. However, if the adhesive strength between the toner and the image carrier is too strong, problems such as difficulties in cleaning may be likely to generate and hence an excessive increase in quantity of residual toner is not desirable. Of course, any increase in quantity of the toner accumulated through cleaning and to be discarded will lead to waste of resources and increase of printing cost (CPC).

Further, when the recycle mechanism is provided as described above, the characteristics of toner such as the distribution in quantity of electrification and the fluidity of toner may be differentiated between those to be derived before and after the recycling, this difference becoming a cause for increase in quantity of recycle and for the deterioration in quality of image.

The toner left remained on the image carrier and having an adhesive force which is not less than 2.5 times as high as an average value of a distribution of adhesive force is higher in adhesive strength to a photoreceptor as compared with the electrostatic attraction to be derived from the transferring electric field. Therefore, if the toner is to be removed from the surface of image carrier by means of a cleaning blade, a stronger scraping force is required to be employed, often giving rise to various problems such as much possibilities of generating the curling of blade, the abrasion of the blade itself, or the shaving of the surface layer of image carrier. Further, the toner particle exhibiting a strong adhesive force is very high in electric charge, is amorphous in configuration, and is enabled to surface-contact with the surface of image carrier, this contacting area the image carrier being increased as additives adhered to the surface of the toner particle is buried or desorbed. As described above, the toner having an adhesive force which is not less than 2.5 times as high as an average value of a distribution of adhesive force is more likely to become residual toner.

In the transferring step, a recording material such as an intermediate transferring medium or an ultimate recording medium is enabled to contact with the toner on the image carrier, and an electric voltage is applied to the back of the recording material to thereby create an electric field in the transferring region, thereby making it possible to transfer the toner from the image carrier to the medium by the effect of the resultant electrostatic attraction. As the electric field is increased, the quantity of toner to be transferred can be increased. However, if the magnitude of electric field becomes too large, an electric discharge is caused to generate on the occasion of removing the recording material from the image carrier, resulting in reverse electrification of the toner, thus often rendering the toner impossible to transfer. Therefore, it is desirable that the transfer of toner is accomplished by an electric field generated prior to the generation of this electric discharge.

The adhesive force of toner can be represented by an equation of: $F=Kq^2+Fv+Fb$ (wherein q is a quantity of charging of one particle of toner; K is a proportional constant; Fv is van der Waals force; and Fb is a liquid crosslinking force).

FIG. 1 shows a graph illustrating one example of the relationship between the quantity of electric charge of toner and the adhesive force of toner.

In this graph, the results of measurement on the adhesive force of toner are plotted under the conditions where the toner having an average particle diameter of 5.3 μm and a largest particle diameter of up to 10 μm is employed and the mixing ratio of the toner to carrier is varied to thereby change the quantity of electrification.

The toner employed as a sample was constructed such that, in order to prevent the toner from being affected by the fluctuation of environmental moisture, silica which was made hydrophobic was adsorbed on the surface of toner particle comprising a coloring agent and a binder.

As shown in the graph, the adhesive force of toner was proportional to the quantity of electric charge of toner. Since the particle diameter of this toner is confined to not more than 10 μm, van der Waals force was more dominant than the liquid crosslinking force. The reason for generating a distribution of adhesive force of toner seems to be attributed to the following factors. Namely, there are various factors based on the fact that there is a distribution in particle diameter of toner, the fact that there is a distribution in van der Waals force since the configuration of toner particle is not completely spherical, the fact that irrespective of the manufacturing method of the toner such as grinding method or polymerization method, it is impossible to make the components of toner completely uniform, thus resulting in non-uniformity in value of K representing the uniformity of the distribution of surface charge, and the fact that due to the non-uniformity of particle size distribution or the non-uniformity of frictional electrification, the quantity of electric charge which each toner particle has is also caused to have a distribution.

Further, the electrostatic attraction acting on the toner by the electric field can be represented by qE (wherein E represents the magnitude of electric field). It is assumed that if $qE>F$, the toner is permitted to be transferred from the image carrier to a recording material. Therefore, the transfer of toner is required to be performed at an electric field of not less than $E=Kq+Fv+Fb)/q$. Since there is a distribution in adhesive force of toner due to various factors as described above, the transferring electric field required for the transfer of toner is also caused to have a distribution which can be hardly determined by way of calculation. Further, since the surface of the image carrier which becomes the surface for the adhesion of toner in the transferring region is formed of a curved surface, the gap between the image carrier and the toner is caused to change in such a manner that it is gradually narrowed and contacted with each other and then it is gradually expanded in contrast to plane-parallel plate. Therefore, the transferring electric field acting on the toner can be also gradually increased up to a maximum value and then gradually decreased. The toner is enabled to start moving toward a recording material at the moment when the electrostatic attraction to be derived from the transferring electric field becomes higher than the adhesive force of toner. However, if the distribution of adhesive force of toner is broad, it is required to apply a high transferring electric field in order to enable the toner of high adhesive force to move. In this case however, the toner of low adhesive force is permitted to start moving due to the effect of a sufficient magnitude of electrostatic force even at the stage where the aforementioned gap is still fairly large. The electric field at the narrowest portion of the gap where the electric field is maximized is required to be less than the magnitude of electric field where Paschen discharge is permitted to initiate (E breakdown). If the toner is permitted to move at the moment when the aforementioned gap is still fairly large, the dust of toner is more likely to generate. It has been found out as a result of experiments performed using various kinds of samples that, in order to realize a transfer efficiency of 97% or more while making it possible to minimize the generation of dust of toner and to suppress the reverse charging of toner at the maximum electric field portion, it is only required to control the ratio of toner having an adhesive force which is not less than 2.5 times as high as an average value of a distribution of adhesive force.

According to the image forming apparatus and the method of forming an image where the first distribution of adhesive force is applied thereto, when the ratio of toner having an adhesive force which is not less than 2.5 times as high as an average value of a distribution of adhesive force is confined to 3% by weight of the entire weight of the toner, it is possible to suppress the quantity of residual toner to not more than 3% by weight, to efficiently consume the toner, and to perform the work in a stable manner for a long period of time without deteriorating the characteristics of toner in the hopper even if the recycle is performed.

In the formation of an image by making use of the image forming apparatus and the method of forming an image where the second distribution of adhesive force is applied thereto, a mechanism for recovering the residual toner from the surface of image carrier into the developing portion concurrent with the development of toner is additionally employed. In this process of forming an image, after finishing the step of transfer, the residual toner is transferred via electrification and exposure steps for forming a succeeding image-forming process to a developing region without being subjected to cleaning. In this developing region, only the toner left remain in the non-image portion in the next electrostatic latent image is recovered into a developing apparatus. Therefore, in the case of image forming employing the second distribution of adhesive force, the influence of the residual toner on the succeeding exposure step (i.e. obstruction of exposure) for example should preferably be taken into account. Due to this obstruction of exposure, the light is slightly interrupted by the residual toner, resulting in an increase, in a slight degree, of residual potential as compared with a surface region of image carrier where the residual toner is not left behind. When this difference in potential is turned into a difference in concentration of toner image after the development thereof and made visible, an image memory is caused to generate.

According to the method of forming an image by making use of the second distribution of adhesive force, since the ratio of the toner having an adhesive force which is not less than 2.5 times as high as an average value of a distribution of adhesive force corresponds to the quantity of residual toner on the occasion of realizing a maximum transferring efficiency, it is possible, by limiting the quantity of residual toner to not more than 1.5% by weight, to prevent the generation of phenomenon where the residual toner badly affects the succeeding image, thus reproducing the residual toner as an image memory.

When the ratio of toner for forming an image is too large, it may become causes for generating unsatisfactory transcription, fixing failure due to insufficient heat quantity in the fixing step, and offset due to temperature gradient between the surface of toner layer (the contacting portion thereof with a fixing roller) and the interior of toner layer. Therefore, the quantity of toner to be fed at the step of development should be suitably set. For example, the quantity of toner at the solid region can be confined to the range of 0.6 $mg/cm^2$ to 0.3 $mg/cm^2$. When the toner is to be transferred to paper at a maximum quantity of 0.6 $mg/cm^2$, if the quantity of residual toner on the image carrier is assumed to be 1.5% by weight based on the entire quantity of toner, it corresponds to a quantity of about 10 $\mu g/cm^2$. Accordingly, assuming that one particular toner is formed of uniform spherical particle having a specific gravity of 1.1, about 3% of the surface of image carrier is covered by the toner having a particle diameter of 5 μm, or about 2% of the surface of image carrier is covered by the toner having a particle diameter of 7 μm. If the surface coverage is confined to this range of 2-3%, it is possible to obviate the obstruction of electrification and exposure and to prevent the generation of image memory.

However, the quantity of residual toner becomes 2% by weight or more and the surface coverage of image carrier becomes 3% or more, the generation of image memory may be caused to occur. Therefore, the quantity of residual toner should preferably be confined to not more than 1.5% by weight.

As described above, in the case of forming an image where a mechanism for recovering the residual toner from the surface of image carrier into the developing portion concurrent with the development of toner is additionally employed, it is possible to confine the quantity of residual toner to 1.5% or less by limiting the ratio of the toner having an adhesive force which is not less than 2.5 times as high as an average value of a distribution of adhesive force to 1.5% by weight or less.

In the formation of an image by making use of the image forming apparatus and the method of forming an image where the third distribution of adhesive force is applied thereto, the toner weak in adhesive force is taken into account.

In the region extending from the image carrier to a recording material, the gap between the roller-like image carrier and the recording material is gradually narrowed, ultimately enabling the image carrier as well as the toner adhered to the surface of the image carrier is permitted to contact with the recording material and then the gap is gradually expanded. On the behind of the recording material which is disposed to face the image carrier, there are disposed a transfer roller, a transfer blade and a voltage-generating device such as a scolotron charger, thereby enabling a voltage to be generated therefrom to create a transferring electric field between the image carrier and the voltage-generating device. The magnitude of this electric field has a special distribution according to the changes of the space and to the distance thereof from the transfer voltage-generating device, so that the toner entering into this space of electric field is enabled to be separated and to move toward the recording material only when the electrostatic attraction to be effected from the electric field become larger than the adhesive strength thereof to the image carrier. If the adhesive force of toner is uniform, all of the toner may be enabled to move all together when the electric field reaches a certain point to accomplish the transferring of toner. However, since the adhesive force of toner is distributed because of various factors such as the particle size distribution of toner, non-uniformity in configuration of toner, non-uniformity in surface components of toner, and non-uniformity in electric charge of toner particle, the separation of toner from the image carrier is initiated gradually from the toner particle having lower adhesive force in accordance with the magnitude of electric field. If the adhesive force of toner is too low, the toner is enabled to be separated from the image carrier even if the space between the image carrier and the recording material is relatively large and the electric field is relatively weak and at the same time, since the distance from the image carrier to the recording material is considerably long, it is difficult for the toner to deposit at a predetermined opposite surface portion of the recording material in conformity with the toner image formed on the image carrier. As a result, the image formed on the recording material would become such that the toner is scattered around the periphery of image, thus deteriorating the quality of image. Therefore, it is desirable that ratio of the toner having a weak adhesive force as compared with the average adhesive force is as small as possible.

According to the method of forming an image by making use of the third distribution of adhesive force, it is possible to obtain a high-quality image where the dust of toner can be prevented from standing out by formulating the developing agent in such a way that the ratio of the developing agent having an adhesive force of not more than 20% of an average value of a distribution of adhesive force in the distribution of adhesive strength to the surface of image carrier is confined to 10% by weight or less based on an entire weight of the developing agent.

In the formation of an image according to the image forming apparatus and the method of forming an image where the fourth distribution of adhesive force is applied thereto, a plurality of developing portions for forming a color image as well as plural kinds of toners differing in color from each other which are to be accommodated respectively in the developing portions are employed.

In the case of a color image forming system of tandem structure provided with two or more image forming units for respectively forming an image of different color on each of image carriers for example, a first toner image formed on an image carrier by means of a first image forming unit is transferred to a recording material at a first transfer region. Subsequently, the recording material having the first toner image transferred thereto is moved to a second transfer region of a second image forming unit and a second toner image formed on an image carrier by means of the second image forming unit is transferred to and superimposed over the un-fixed first toner image formed on the recording material. This cycle is repeated at a required number of times in conformity with the number of the image forming units to obtain a laminated image consisting of color images employed therein. The resultant laminated image is then fixed as it is when the image forming system is a direct transfer system or is further transferred from an intermediate transfer medium to a recording medium such as paper when the image forming system is an intermediate transfer system and then fixed to obtain a final image.

In the transfer region of the second image forming unit as well as in the transfer region of the succeeding image forming unit, there are possibilities of generating a phenomenon that the toner of the preceding image forming unit that has been already transferred onto the recording material is reversely transferred onto the image carrier concurrent with the transferring of toner of the image forming unit onto the recording material by the effect of transferring electric field. Once the reverse transcription is generated, defectives of image may be caused to generate. For example, the concentration of image of toner image on the recording material may be reduced, or the toner on a fine line may be lost to deteriorate the sharpness of image. In particular, in the cleaner-less process where recovery of residual toner is performed concurrent with the development of image at the developing portion without disposing a cleaning mechanism at a latter stage of the transferring portion of image carrier, since the toner of the previous stage that has been reversely transferred is recovered concurrent with the residual toner, if the quantity of the toner of the previous stage is too large, the ratio of different color toner inside the developing device is increased to fluctuate the hue of toner, thereby making it impossible to control the color. Therefore, it is desirable, in the case of a color image forming device, to take measure to minimize the quantity of reverse transcription as much as possible. Generally, there is a conflicting feature between the transcription efficiency and the reverse transcription efficiency. Namely, under the transferring conditions where the transcription efficiency is enhanced, the reverse transcription efficiency is more likely caused to increase. Under the transferring conditions where the reverse transcription efficiency is minimized, the transcription efficiency is more likely caused to decrease. In particular, the toner which is weak in adhesive force is small in quantity of electric charge. Therefore, the toner can be easily moved by the force of transferring electric field and can be easily separated from the image carrier and hence to easily perform the transcription. This means on the contrary that the toner can be easily separated from a recording material thus easily generating reverse transcription.

The present inventors have noticed an interrelationship between the quantity of toner having an adhesive force which is not more than 20% of average adhesive force and the quantity of the reverse transcription and tried to optimize the transcription efficiency and the reverse transcription efficiency through the control of the aforementioned interrelationship.

According to the method of forming an image by making use of the fourth distribution of adhesive force, it has been made possible to suppress the possibility of reverse transcription even under the conditions which make it possible to enhance the transcription efficiency by limiting the ratio of the toner having an adhesive force of not more than 20% of an average value in the distribution of adhesive strength of toner to the image carrier to 5% by weight. Further, due to this limitation, the reverse transcription can be suppressed to 2% or less and the problem of the fluctuation of color due to color mixture can be prevented even if the aforementioned cleaner-less process is applied to the formation of image.

By the way, when the aforementioned regulation of the third distribution of adhesive force is applied to each of the aforementioned first and second distributions of adhesive force, the advantages to be derived from both regulations can be obtained concurrently. Likewise, when the aforementioned regulation of the fourth distribution of adhesive force is applied to each of the aforementioned first and second distributions of adhesive force, the advantages to be derived from both regulations can be obtained concurrently.

The measurement of the adhesive force of toner to be employed in the present invention can be performed for example by mounting an angle rotor (CP100MX; Hitachi Kohki Co., Ltd.) on an ultacentrifugal separator (P100AT2; Hitachi Kohki Co., Ltd.).

Figure 2:
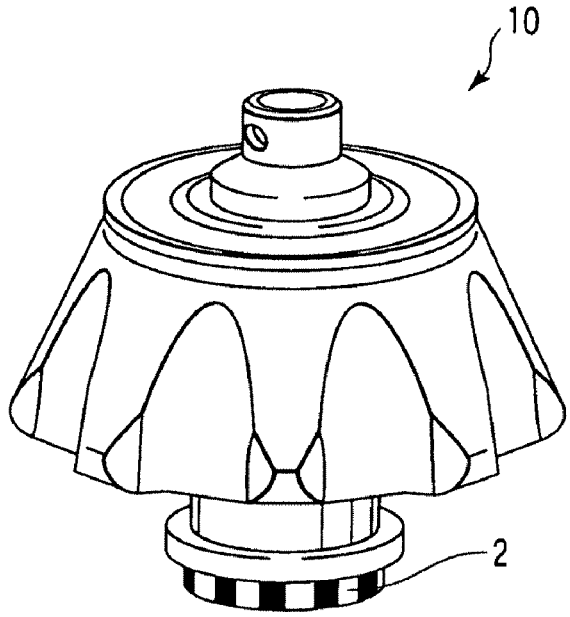
FIG. 2 is a perspective view showing an external appearance of an angle rotor.
Figure 3:
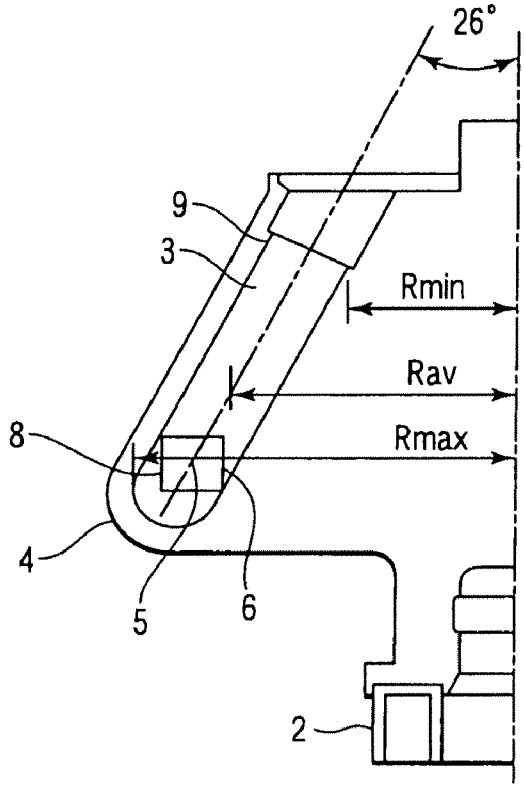
FIG. 3 is a longitudinal cross-sectional view of part of the angle rotor shown in FIG. 2 taken along the rotational axis thereof.
Figure 4:
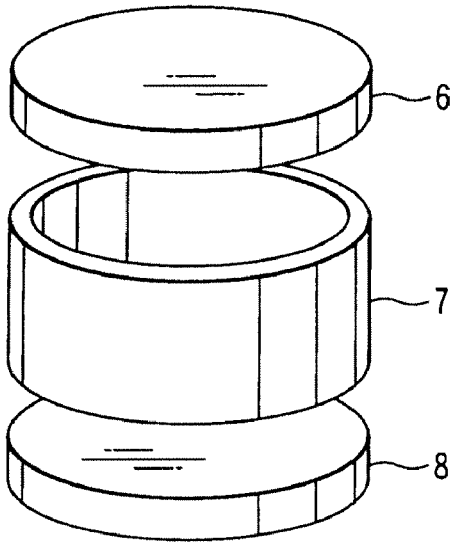
FIG. 4 is an exploded perspective view illustrating the construction of the cell for mounting a sample in the angle rotor.

FIG. 2 illustrates the external appearance of the angle rotor; FIG. 3 shows a longitudinal cross-sectional view of part of the angle rotor shown in FIG. 2 taken along the rotational axis thereof; and FIG. 4 shows an exploded perspective view illustrating the construction of the cell for mounting a sample in the angle rotor.

As shown in FIGS. 2 and 3, this angle rotor 10 is provided, in the cone-like rotator 4 placed on a base 2, with a cell-holding portion 9 having a pit-like configuration with the central axis thereof being inclined at an angle of 26° relative to the rotational axis 1 of the rotor 10. A cell 3 can be placed and secured in this cell-holding portion 9. The cell 3 may be provided with a sample container 5 for accommodating and separating a sample.

The sample container 5 is constituted by a cylindrical spacer 7, a disc-like sample mounting plate 6 to be disposed on one end of the spacer 7, and a sample-receiving plate 8 for accepting a separated sample. In this cell 3, the sample-receiving plate 8 will be disposed at a location which is remote from the rotational axis, and the sample mounting plate 6 will be disposed at a location which is close to the rotational axis.

First of all, a photosensitive sheet laminated, on the surface thereof, with a surface protecting layer of the same kind as the photoreceptor is prepared. In order to measure the adhesive force, the surface protecting layer is required to be the same as the photoreceptor. However, in order to reproduce the adhesion of toner to the photoreceptor, a sheet laminated with a CGL layer or a CTL layer in the same manner as the photoreceptor may be employed. Then, this sheet is wound around a raw aluminum tube and the photosensitive layer is grounded to GND. The resultant body is set to the position of the photosensitive drum and then, toner is developed on the surface of the sheet and adhered thereto.

The photosensitive sheet having the toner adhered thereto is cut into a size of the sample-receiving plate 8 and, by making use of a double-coated tape, is stuck to the side of the sample-receiving plate 8 which is adapted to be contacted with the spacer 7.

The outer diameter of all of the sample mounting plate 6, the sample-receiving plate 8 and the spacer 7 is 7 mm for example, and the thickness and height of the cylindrical spacer are 1 mm and 3 mm, respectively, for example. The minimum rotational diameter (Rmin) of the cell 3 as it is mounted on the angle rotor is 3.56 cm, the maximum rotational diameter (Rmax) thereof is 7.18 cm for example and an average diameter (Rav) thereof is 5.37 cm for example.

The sample container 5 is positioned in the cell 3 in such a manner that the rear side of sample mounting plate 6 where the sample is attached is directed to face the rotational center. The cell 3 is positioned in the cell-holding portion 9 of the angle rotor 10. Then, the angle rotor 10 is mounted on an ultracentrifugal separator (not shown).

The ultracentrifugal separator is rotated at 10000 rpm for example, after which the sample mounting plate 6 and the sample-receiving plate 8 are taken out and the toner adhering to these plates are removed by making use of mending tape and put on a white paper. The concentration of the reflection of the tape having the toner adhered thereto is measured by making use of Macbeth densitometer.

The quantity of toner that has been separated as well as the quantity of toner that has not been separated are respectively calculated from the concentration of the reflection.

Further, the rotational speed of the ultracentrifugal separator is increased stepwise suitably up to 100000 rpm and the same procedures as explained above are repeated.

The centrifugal acceleration (RCF) acting on the sample mounted in the cell by the effect of the rotation of rotor can be expressed as follows:

$$RCF=1.118\times10-5\times r\times N^2\times g \quad (1)$$

r: Distance between the set position of sample and the rotational center $N^{[2]}$: Rotational speed (rpm)

g: Gravitational acceleration

The centrifugal force acting on the toner when the weight of a single particle of toner is defined as m can be expressed as follows:

$$F=RCF\times m \quad (2)$$

$$m=(4/3)\pi\times r^3\times\rho \quad (3)$$

r: Diameter (assumed as spherical)

ρ: Specific gravity of toner

In this invention, the average adhesive strength between the toner and the photoreceptor is determined from the calculation wherein the centrifugal force acted on the toner at each rotational speed (F=RCF×m - - - (2)) is multiplied by the ratio of the toner that has been separated at each rotational speed and all of the resultant values are added together.

By the way, since the adhesive force is greatly influenced by the quantity of electrification of toner, it is desirable, in order to accurately measure the adhesive force, to prepare the measuring samples in such a manner that the toner is adhered according to the actual process.

The developing agent to be employed in the present invention comprises a colorant, and toner particle containing a binder resin, and also, as required, toner including additives to be applied to the surface of the toner particle. In the case of binary developing agent, the toner and carrier are mixed together.

As for the binder resin, it is possible to employ polyester resin, styrene-acrylic resin, etc.

As for the colorant, it is possible to employ known pigments and dyes such as carbon black, condensed polycyclic pigments, azo pigments, phthalocyanine pigments, inorganic pigments, etc.

As for the fixing-assisting agent, it is possible to employ wax, electrification controlling agent (CCA), these fixing-assisting agents being added into the particles of toner. Further, in order to improve the fluidity of toner, inorganic fine particle such as silica may be applied as an additive to the surface of the particles of toner.

The particles of toner can be manufactured by known manufacturing method such as grinding, polymerization, etc.

In order to satisfy the regulation of the distribution of adhesive force, the developing agent to be employed in the present invention should preferably be adjusted so as to make the distribution of particle size sharp by eliminating fine particles and coarse particles.

It is preferable to confine the volume average particle diameter of developing agent to the range of 4 to 7 μm.

It is also preferable to classify toner particle so as to eliminate those having a particle diameter of not more than 2 μm and those having a particle diameter of not less than 10 μm. In order to make the surface components of particle uniform, the conditions in the manufacture of toner by means of grinding should preferably be controlled so as to prevent the generation of non-uniformity in temperature and in stress of kneading apparatus. Further, in order to prevent non-uniformity of components in the developing agent, the quantity of component to be loaded as well as the timing of loading should be controlled. Further, in order to prevent the non-uniformity in deposition of additives on toner particle, it is preferable to calculate the loading quantity of additives on the basis of the particle diameter of additives and the particle diameter of toner so as to enable one or two layers of additives to be formed on the surface of toner, thereby making it possible to uniformly deposit the additives on the surface of toner.

Further, in order to make the distribution in electrification of toner uniform, it is preferable, in the case of binary developing agent, to mix the toner with a suitable quantity of carrier particle, and it is also preferable, in the case of one-component developing agent, to suitably set the contacting pressure and configuration between the electrificating member and developing agent in the developing portion.

In the case of binary (two-component) development, the carrier to be employed therein may be formed of a magnetic carrier such as resin particle containing therein ferrite, magnetite, iron oxide or magnetic powder, wherein the surface of carrier may be entirely or partially coated with resin.

FIGS. 5, 6, 7 and 8 illustrate respectively one example of image forming apparatus according to the present invention.

Figure 5:
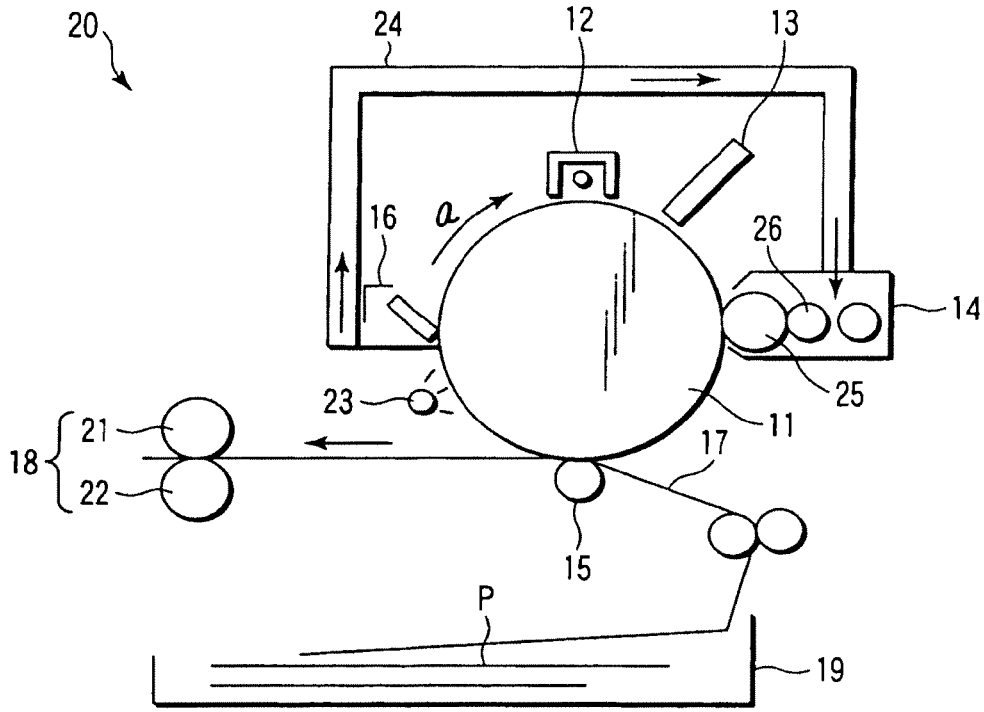
FIG. 5 is a diagram schematically illustrating one example of the image forming apparatus according to the present invention.

As shown in FIG. 5, the image forming apparatus 20 comprises an image forming unit which is constituted by a photoreceptor 11, around which an electrificating device 12, an exposure portion 13, a developing device 14, a transferring portion 15 and a cleaning device 16 are successively disposed so as to face the photoreceptor 11.

The transferring portion 15 is disposed so as to face the photoreceptor 11 with a delivery member 17 being interposed therebetween. At the downstream side of the delivery member 17 is disposed a fixing portion 18. A delivery passageway 24 is provide between the cleaning device 16 and the developing device 14, thereby constructing a recycle mechanism for recovering residual toner.

In this image forming apparatus 20, the photoreceptor 11 is made rotatable in the direction indicated by arrow "a" and is uniformly impressed by a surface potential of −500~800V by means of the charging device 12 such as a charger wire, a tandem type charger, a corona charger, a contact type charging roller, a non-contact type charging rotor, a solid charger, etc. By means of the exposure portion 13, an electrostatic image is formed on the photoreceptor 11. As for the exposure portion, a light source such as laser, LED, etc. may be employed. By the way, as for the photoreceptor 11, it is possible to employ a plus-charged or minus-charged organic photosensitive layer, an amorphous silicon layer, etc. The photosensitive layer to be formed on the surface of photoreceptor may be further laminated with an electric charge-generating layer, an electric charge-transfer layer and a protective layer. Alternatively, a single photosensitive layer may be constructed so as to exhibit a plurality of functions. The developing device 14 comprises a developing roller 25 having a magnet roller built therein for example and is constructed to feed a negatively charged toner for example to an electrostatic image to develop an image by way of a magnetic brush development which is designed to deliver a binary developing agent. For the purpose of forming an electric field for enabling the toner to adhere to the electrostatic image, a developing bias is applied to the developing roller 25. Further, in order to enable the toner to uniformly and stably adhere to the surface of photoreceptor, the developing bias may be composed such that DC is superimposed by AC. The developing agent to be employed herein comprises a colorant, and a toner containing a binder resin. This developing agent is formulated such that, in the distribution of adhesive strength of developing agent to the surface of photoreceptor 11, the ratio of developing agent having an adhesive force which is not less than 2.5 times as high as an average value of a distribution of adhesive force is confined to 3% by weight or less based on an entire weight of the developing agent.

In the developing device 14, for example, 100 g~700 g of a binary developing agent consisting of carrier and toner are placed in the toner hopper thereof and the developing agent is delivered to the developing roller 25 by means of agitation auger 26. After part of the toner is consumed due to the development, the residual toner is permitted to leave from the developing roller 25 at the separating position of the developing roller 25 and returned to the developing agent storage region by means of the agitation auger 26. A toner concentration sensor (not shown) is attached in the developing agent storage region, so that when any decrease in quantity of developing agent is detected by this concentration sensor, the signal thereof is transmitted to the toner hopper. As a result, fresh toner is replenished. The quantity of consumption of toner can be estimated from the integration of printing data and/or from detection of the quantity of developing toner on the photoreceptor. The replenishment of fresh toner may be performed on the basis of the aforementioned estimation. It is also possible to utilize both of these means, i.e. the output of sensor and the estimation of the quantity of consumption of toner.

At the downstream side of the developing device 14, the delivering member 17 is press-contacted with the photoreceptor 11 and a recording medium such as paper P which has been fed from the paper supply portion 19 is interposed between the delivering member 17 and the photoreceptor 11. Further, by the effect of a bias voltage of +300V to 5 kV for example which has been applied to the delivering member 17 from a high-voltage power source (not shown), the toner image on the photoreceptor 11 is transferred to the paper. The paper P that has passed through a transcription nip is then moved to the fixing device 18.

The fixing device 18 comprises a couple of rollers consisting of a heat roller 21 and a press roller 22. The paper P is passed through an interface between the press roller 22 and the heat roller 21 under the condition where the toner image is contacted with the heat roller 21, thereby fixing the toner image on the paper P.

After finishing the transfer of toner image, the residual toner is removed by means of the cleaning device 16 at the downstream region of the transcription nip and destaticized by making use of destaticizing means 23. The residual toner removed by the cleaning device 16 is delivered by means of auger (not shown) into the delivering passageway 24 and recovered in the developing device 14.

By the way, when one-component development system is to be employed, only toner is stored in the developing agent storage region and then delivered to the surface of developing roller by means of known member such as a delivering auger, an intermediate delivery sponge roller, etc. Then, by means of a toner charging member such as a silicone rubber blade, a fluorine-containing rubber blade, a metal blade, etc. which is press-contacted with the surface of developing roller, the toner is frictionally charged, thus developing an electrostatic latent image. The developing roller is formed of an elastic roller having a conductive rubber layer on the surface thereof or formed of a metallic roller made of SUS and having a roughened surface which is effected by making use of sand blast. Further, this developing roller is disposed in contact with the photoreceptor or in non-contact with the photoreceptor and is enabled to rotate at a rotational speed which differs from that of the surface of the photoreceptor. In order to assist the adhesion of toner onto the electrostatic latent image, a developing bias is applied to the developing roller. Further, in order to enable the toner to uniformly and stably adhere to the surface of photoreceptor, the developing bias may be composed such that DC is superimposed by AC.

Further, instead of the aforementioned developing agent, the particles of developing agent can be formulated such that, in the distribution of adhesive strength of developing agent to the surface of photoreceptor, the ratio of the particles of developing agent having an adhesive force of not more than 20% of an average value of a distribution of adhesive force in the distribution of adhesive strength to the surface of image carrier is confined to 5% by weight or less.

Further, the particles of developing agent can be formulated such that, in the distribution of adhesive strength of developing agent to the surface of photoreceptor, the ratio of developing agent having an adhesive force which is not less than 2.5 times as high as an average value of a distribution of adhesive force is confined to 3% by weight or less based on an entire weight of the developing agent, and, at the same time, the ratio of the particles of developing agent having an adhesive force of not more than 20% of an average value of a distribution of adhesive force in the distribution of adhesive strength to the surface of image carrier is confined to 5% by weight or less.

Figure 6:
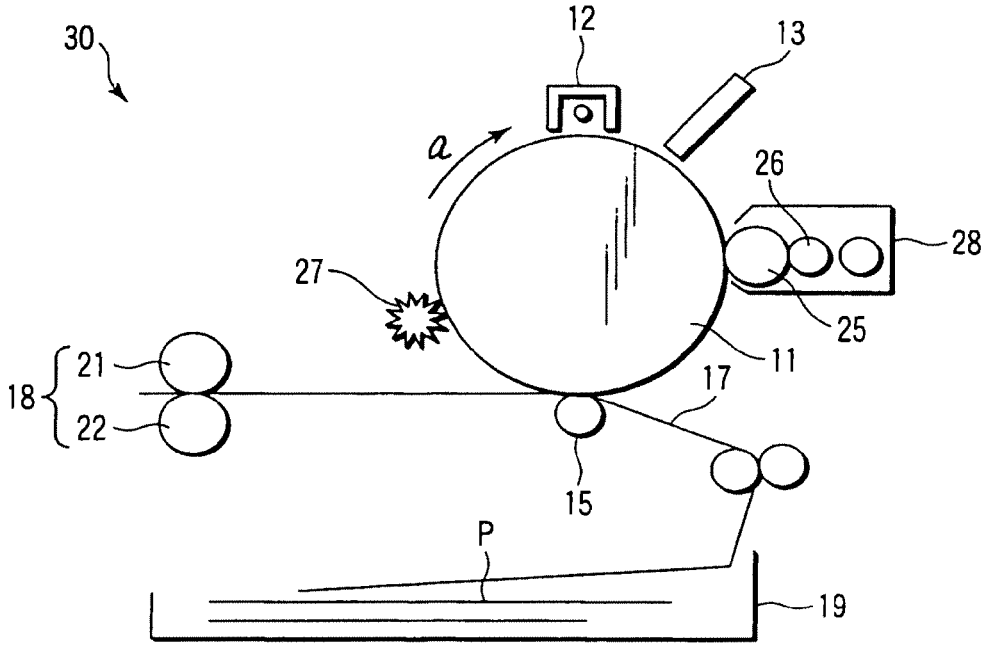
FIG. 6 is a diagram schematically illustrating another example of the image forming apparatus according to the present invention.

FIG. 6 shows a diagram schematically illustrating another example of the image forming apparatus according to the present invention. The image forming unit of this image forming apparatus is fundamentally the same as that shown in FIG. 5 except that the cleaning device 16 and the delivery passageway 24 are not provided, a developing device 28 having a development/cleaning mechanism is substituted for the developing device 14, and a memory disturbing member 27 is interposed between the transferring portion 15 and the charging device 12. The developing agent to be employed herein is formulated such that, in the distribution of adhesive strength of each developing agent to the surface of photoreceptor 11, the ratio of developing agent having an adhesive force which is not less than 2.5 times as high as an average value of a distribution of adhesive force is confined to 1.5% by weight or less based on an entire weight of the developing agent.

By the way, it is also possible to dispose a temporary recovering member (not shown) so as to make it possible to temporarily recover the residual toner in the developing device and to deliver it again to the image carrier. In order to enable the memory disturbing member and the temporary recovering member to function efficiently, a plus and/or a minus voltage may be applied thereto.

Figure 7:
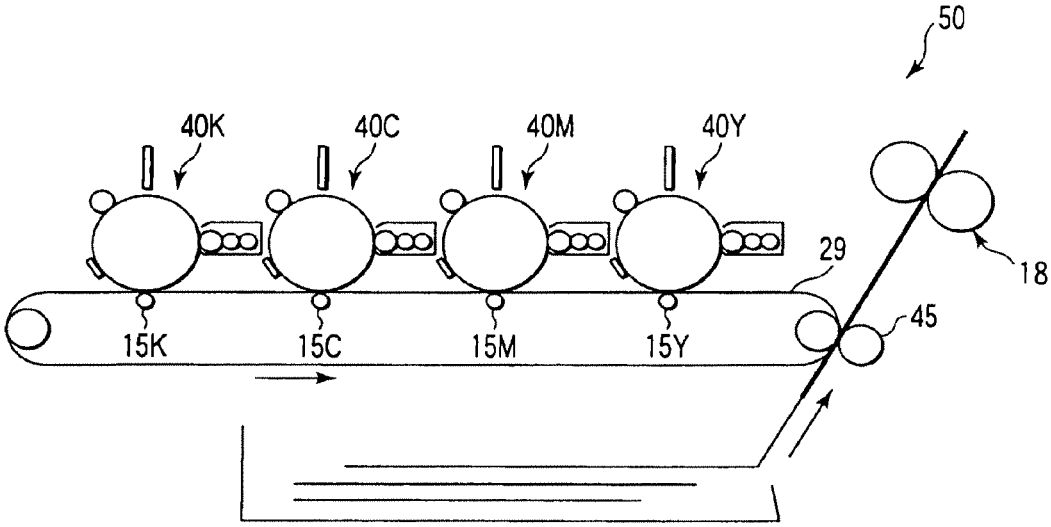
FIG. 7 is a diagram schematically illustrating another example of the image forming apparatus according to the present invention.

FIG. 7 shows a diagram schematically illustrating one example of the color image forming apparatus according to the present invention.

This color image forming apparatus 50 is constructed in the same manner as the imaging unit shown in FIG. 6, wherein image forming units 40Y, 40M, 40C and 40K accommodating therein a yellow color developing agent, a Magenta color developing agent, a cyan color developing agent and a black color developing agent, respectively, are arranged in four stages so as to enable these units to face the transferring regions 15Y, 15M, 15C and 15K, respectively, through an intermediate transferring member 29, and a secondary transferring portion 45 and a fixing region 18 are disposed on the downstream side of the transferring region 15K. In the distribution of adhesive strength of each color developing agent to the surface of photoreceptor, the ratio of developing agent having an adhesive force which is not less than 2.5 times as high as an average value of a distribution of adhesive force is confined to 1.5% by weight or less based on an entire weight of the developing agent.

Figure 8:
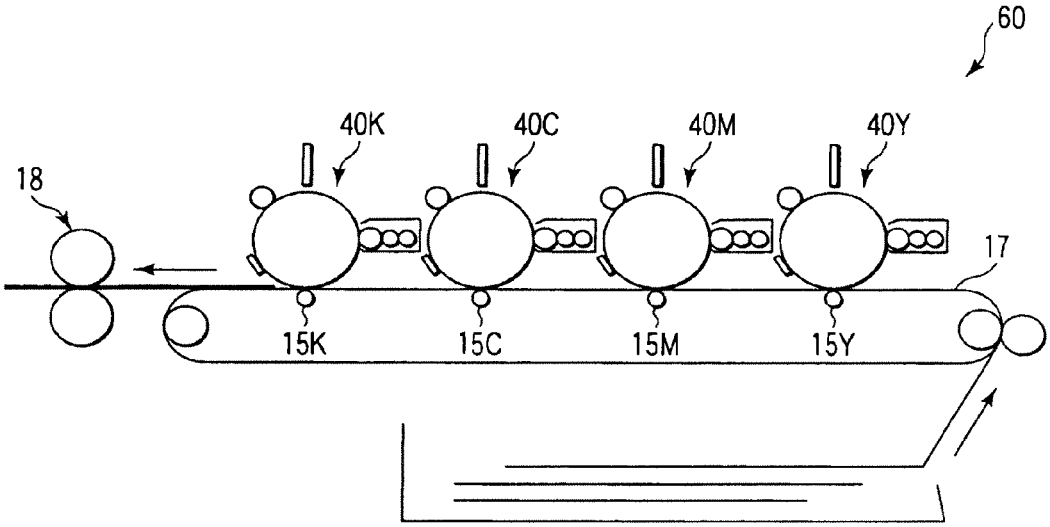
FIG. 8 is a diagram schematically illustrating another example of the image forming apparatus according to the present invention.

FIG. 8 shows a diagram schematically illustrating another example of the color image forming apparatus according to the present invention.

This color image forming apparatus 60 is constructed in the same manner as the imaging unit shown in FIG. 6, wherein image forming units 40Y, 40M, 40C and 40K accommodating therein a yellow color developing agent, a Magenta color developing agent, a cyan color developing agent and a black color developing agent, respectively, are arranged in four stages so as to enable these units to face the transferring regions 15Y, 15M, 15C and 15K, respectively, through a transferring member 17, and a fixing region 18 is disposed on the downstream side of the transferring region 15K. In the distribution of adhesive strength of each color developing agent to the surface of photoreceptor, the ratio of developing agent having an adhesive force which is not less than 2.5 times as high as an average value of a distribution of adhesive force is confined to 1.5% by weight or less based on an entire weight of the developing agent.

Next, the present invention will be more specifically explained with reference to experimental examples.

EXPERIMENTAL EXAMPLES

Four kinds of toners and two kinds of carriers were prepared as follows.

Preparation of Toner A:

28 parts by weight of polyester resin, 7 parts by weight of Carmine 6B, 5 parts by weight of rice wax and one part by weight of carnauba wax were mixed and kneaded by making use of Kneadex (YPK Co., Ltd.) to prepare a master batch. After being subjected to coarse crushing, the master batch is further mixed with 58 parts by weight of polyester resin and one part by weight of CCA. The resultant mixture was then kneaded, coarsely pulverized and finely pulverized to obtain particles. Then, by means of elbow jet classification, parts of the particles having a particle diameter of 8 μm or more and having a particle diameter of 3 μm or less were removed to obtain toner particle having a volume average particle diameter of 5.3 μm.

To 100 parts by weight of the toner particle thus obtained, 3.5 parts by weight of silica having a primary particle diameter of 20 nm was added as an additive by making use of Henschel mixer to obtain Toner A.

Preparation of Carrier α:

To spherical ferrite core having a volume average particle diameter of 43 μm, silicon resin coat having carbon black dispersed therein was applied to obtain Carrier α having a surface resistance of: $7\times10^{8}\Omega/cm^{2}$.

Preparation of Toner B:

A mixture comprising 65 parts by weight of styrene monomer, 21 parts by weight of acrylic monomer, 6 parts by weight of rice wax, 7 parts by weight of Carmine 6B, and one part by weight of CCA was subjected to emulsion polymerization to manufacture polymer particle having a diameter of 0.5 μm. Then, the polymer particle was subjected to aggregation, washing and drying to obtain toner particle having an average particle diameter of 5.4 μm. The sphericity of the toner particle thus obtained was 0.96. To 100 parts by weight of this toner particle, 2.7 parts by weight of silica having a primary particle diameter of 25 nm and 0.5 part by weight of titanium oxide were added as an additive to obtain Toner B.

Preparation of Toner C:

Toner A was subjected to suffusing treatment to thereby apply mechanical globularization treatment to Toner A prior to the addition of silica thereto, thus obtaining toner particle having a sphericity of 0.97. Then, to 100 parts by weight of the toner particle thus obtained, 3 parts by weight of silica having a primary particle diameter of 20 nm was added as an additive by making use of Henschel mixer to obtain Toner C.

Preparation of Carrier β:

To spherical ferrite core having a volume average particle diameter of 35 μm, fluororesin coat having carbon black dispersed therein was applied to obtain Carrier β having a surface resistance of: $1\times10^{9}\Omega/cm^{2}$.

Preparation of Toner D:

4 parts by weight of silica having a primary particle diameter of 20 nm was added to and sufficiently dispersed in a nonpolar hydrocarbon solvent such as isoper to obtain a dispersion. Then, to this dispersion, aggregated and washed polymer particle was added to enable the silica particle to uniformly adhere to the surface of polymer particle. Thereafter, the silica suspended was removed and the residual product was dried to obtain Toner D.

Experiment 1

(1) A Combination of Toner A and Carrier α:

9 parts by weight of Toner A was mixed with 91 parts by weight of Carrier α to obtain a developing agent.

The developing agent thus obtained was applied to an image forming apparatus having the same structure as shown in FIG. 5 except that a film having the same photosensitive layer as the photoreceptor was wound around the surface of photoreceptor, thereby performing electrification, exposure and development of toner.

The film where the toner was developed was taken out as it is and the distribution of adhesive force of toner was measured. The results are shown in FIG. 9.

Figure 9:
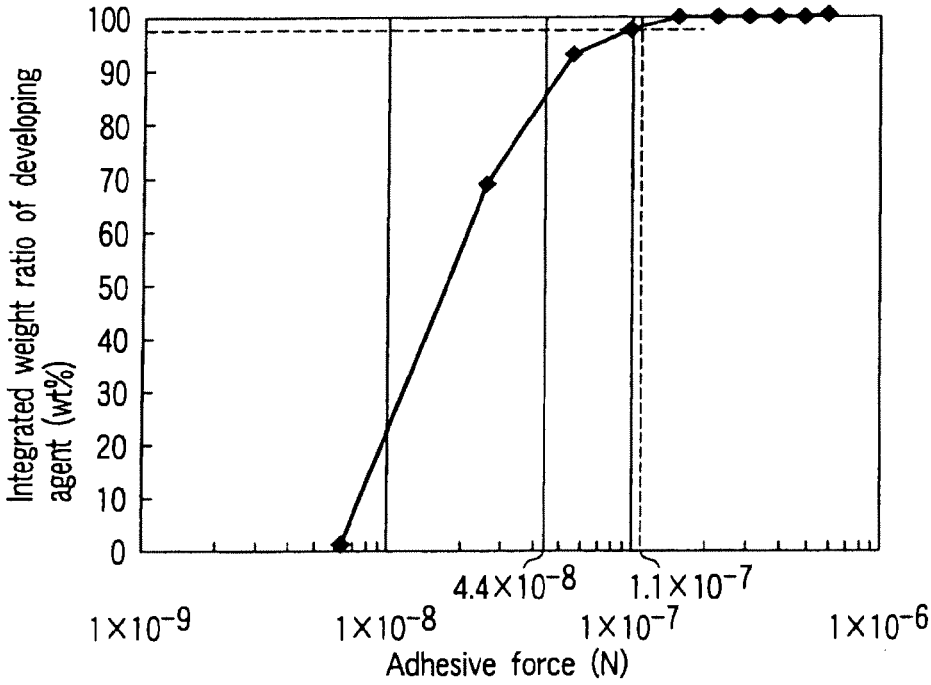
FIG. 9 is a graph illustrating one example of a first distribution of adhesive force to be employed in the present invention.

FIG. 9 shows a graph illustrating one example of a first distribution of adhesive force to be employed in the present invention. This graph illustrates the relationship between the adhesive force of the developing agent and the added weight ratio of the developing agent having the aforementioned adhesive force.

As shown in FIG. 9, an average value of the adhesive force was $4.4\times10^{8}$ (N). Further, the adhesive force which was 2.5 times as high as this average value was $1.1\times10^{-7}$ (N). The ratio of the developing agent having an adhesive force of less than $1.1\times10^{-7}$ (N) was about 96.9% by weight. The ratio of the developing agent having an adhesive force of not less than $1.1\times10^{-7}$ (N) was a balance of about 3.1% by weight.

Further, there was prepared an image forming apparatus having the same structure as that of FIG. 5 except that an intermediate transferring body was substituted for the transferring member and that the recording medium was not fed thereto. The aforementioned developing agent was applied to this image forming apparatus to permit the developing agent to be transferred to the intermediate transferring body. The transferring properties of toner were measured in such a manner that the toner left remained on the photoreceptor was peeled away by making use of tape and the tape was then stuck on a white paper. The concentration of reflection of the toner was measured by making use of Macbeth densitometer and the measured result was applied to the calibration formula related to the concentration and quantity of toner, thereby determining the transferring properties of toner.

Figure 10:
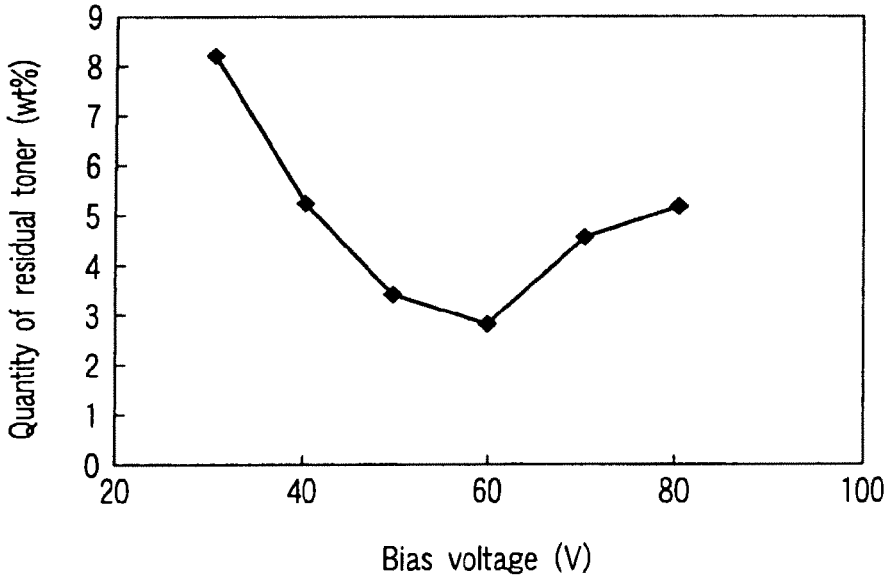
FIG. 10 is a graph illustrating the relationship is between bias voltage and the quantity of residual toner.

The results thus obtained are shown in FIG. 10.

FIG. 10 is a graph illustrating the relationship between bias voltage and the quantity of residual toner.

It was found from FIG. 10 that the quantity of residual toner under the conditions where most excellent transferring efficiency was obtainable was 3.0% by weight.

When a life test was performed using these apparatus and developing agent, the fluctuation in quantity of electrification of toner was confined within a permissible range even if the printing was repeated up to 100K, thus not indicating any inconvenience in the recycling of toner.

The Toner A was mixed with the Carrier α at a mixing ratio of 5% by weight and the distribution of adhesive force and the quantity of residual toner were measured. As a result, an average adhesive force was $9.6\times10^{-8}$ (N) and the adhesive force which is 2.5 times as high as this average value was $2.4\times10^{-7}$ (N). The ratio of the developing agent having an adhesive force of not less than $2.4\times10^{-7}$ (N) was about 4.5% by weight. The quantity of residual toner under the conditions where most excellent transferring efficiency was obtainable was 4.2% by weight.

When a life test was performed using this developing agent, the quantity of electrification of toner was gradually increased and hence the concentration of image was decreased. Namely, the initial concentration, i.e. 1.5, of image was decreased to 1.35 as the printing was repeated up to 100K.

The same process as described in Experiment 1 was repeated except that the mixing ratio of the Carrier α to the Toner A was varied, thereby obtaining several kinds of developing agents each indicating a varied distribution of adhesive force. The ratio of the developing agent having an adhesive force which is not less than 2.5 times as high as an average value of a distribution of adhesive force and the quantity of residual toner were measured and the life test of toner was performed. The results are shown in the following Table 1.

TABLE 1

| Samples No. | Ratio of toner having adhesive force at least 2.5 times higher than average | Ratio of residual toner under best transfer conditions | Results on life |
|---|---|---|---|
| 1 | 1 wt % | 1.20 wt % | 100K: OK |
| 2 | 2.70 wt % | 2.60 wt % | 100K: OK |
| 3 | 3.00 wt % | 3.10 wt % | 100K: OK |
| 4 | 3.50 wt % | 3.70 wt % | Image density lowered from 1.5 to 1.4 at 100K |
| 5 | 4.50 wt % | 4.20 wt % | Image density lowered from 1.5 to 1.35 at 100K |
| 6 | 5 wt % | 5.10 wt % | Image density lowered from 1.5 to 1.35 at 100K |

(2) A Combination of Toner B and Carrier α:

The Toner B was mixed with 95 parts by weight of the Carrier α at a mixing ratio of 5% by weight to prepare a developing agent. By making use of this developing agent, the distribution of adhesive force and the quantity of residual toner were measured in the same manner as described above. As a result, an average adhesive force was $1.05\times10^{-7}$ (N) and the adhesive force which is 2.5 times as high as this average value was $2.63\times10^{-7}$ (N). The ratio of the developing agent having an adhesive force of not less than $2.63\times10^{-7}$ (N) was about 2.7% by weight. The quantity of residual toner under the conditions where most excellent transferring efficiency was obtainable was 2.6% by weight.

When a life test was performed using this developing agent, the fluctuation in quantity of electrification of toner was confined within a permissible range even if the printing was repeated up to 100K, thus not indicating any inconvenience in the recycling of toner.

Experiment 2

(1) A Combination of Toner C and Carrier β:

11 parts by weight of Toner C was mixed with 89 parts by weight of Carrier β to obtain a developing agent.

The developing agent thus obtained was applied to an image forming apparatus having the same structure as shown in FIG. 6 except that a film having the same photosensitive layer as the photoreceptor was wound around the surface of photoreceptor, thereby measuring the distribution of adhesive force, the quantity of residual toner, and performing the life test in the same manner as in Experiment 1.

As a result, an average value of the adhesive force was $1.04\times10^{-7}$ (N). Further, the adhesive force which was 2.5 times as high as this average value was $2.6\times10^{-7}$ (N). The ratio of the developing agent having an adhesive force of not less than $2.6\times10^{-7}$ (N) was 1.5% by weight. The quantity of the residual toner was 1.4% by weight.

Further, when the formation of image was performed by making use of this developing agent, it was possible to prevent the generation of any inconvenience such as the generation of negative memory due to the hindrance of exposure or the generation of positive memory due to recovery failure. When a life test was performed using this developing agent, the generation of memory image was not recognized even if the printing was repeated up to 100K.

(2) A Combination of Toner D and Ferrite Carrier β:

11 parts by weight of Toner D was mixed with 89 parts by weight of ferrite carrier β to obtain a developing agent. By making use of this developing agent, the distribution of adhesive force and the quantity of residual toner were measured in the same manner as described above.

As a result, an average value of the adhesive force was $1.04\times10^{-7}$ (N). Further, the ratio of the developing agent having an adhesive force which was at least 2.5 times as high as this average value, i.e. not less than $2.6\times10^{-7}$ (N), was 1% by weight. The quantity of the residual toner was 1.2% by weight.

Further, when the formation of image was performed by making use of this developing agent, it was possible to prevent the generation of any inconvenience such as the generation of negative memory due to the hindrance of exposure or the generation of positive memory due to recovery failure. When a life test was performed using this developing agent, the generation of memory image was not recognized even if the printing was repeated up to 100K.

(3) A Combination of Toner A and Carrier α:

9 parts by weight of Toner A was mixed with 91 parts by weight of Carrier α to obtain a developing agent. By making use of this developing agent, the distribution of adhesive force and the quantity of residual toner were measured in the same manner as described above.

As a result, an average value of the adhesive force was $4.4\times10^{-8}$ (N). Further, the ratio of the developing agent having an adhesive force which was at least 2.5 times as high as this average value, i.e. not less than $1.1\times10^{-7}$ (N), was 3.1% by weight. The quantity of the residual toner was 3.0% by weight.

Further, when the formation of image was performed in the same manner as described above by making use of this developing agent, the exposure of the next image was obstructed by the residual toner, thereby making it impossible to sufficiently lower the electric potential of the image portion, thus generating a negative memory.

Further, when life test was performed by making use of this apparatus, the degradation of the surface of image carrier as well as the deterioration of recovery efficiency of residual toner were recognized. It was impossible to recover the residual toner when the printing was repeated 80K, thus permitting the generation of so-called positive memory where a preceding image is transferred to the next image.

(4) A Combination of Toner B and Carrier α:

5 parts by weight of Toner B was mixed with 95 parts by weight of Carrier α to obtain a developing agent. By making use of this developing agent, the distribution of adhesive force and the quantity of residual toner were measured in the same manner as described above.

As a result, an average value of the adhesive force was $1.05\times10^{-7}$ (N). Further, the ratio of the developing agent having an adhesive force which was at least 2.5 times as high as this average value, i.e. not less than $2.63\times10^{-7}$ (N), was 2.7% by weight. The quantity of the residual toner was 2.6% by weight.

Further, when the formation of image was performed in the same manner as described above by making use of this developing agent, the generation of slight degree of negative memory was recognized at the initial stage and the generation of positive memory was recognized when the printing was repeated up to 90K.

Figure 11:
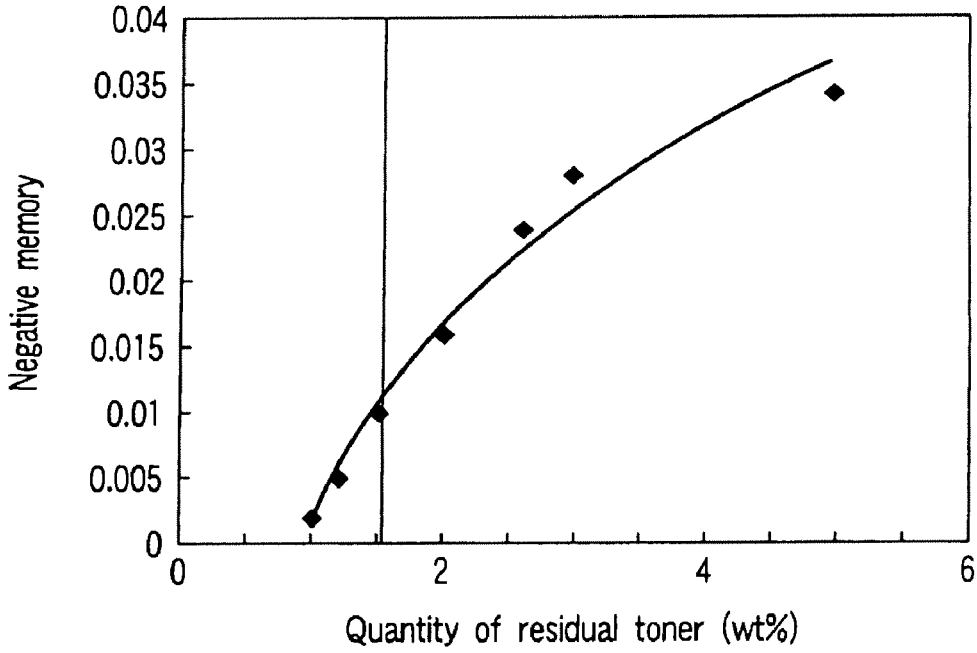
FIG. 11 is a graph illustrating the relationship between the quantity of residual toner and negative memory.

FIG. 11 shows a graph illustrating the relationship between the quantity of residual toner and negative memory, which was obtained with the employment of the developing agent manufactured from a mixture comprising 11 parts by weight of Toner D and 89 parts by weight of carrier β, wherein the quantity of residual toner was fluctuated by changing the bias voltage.

By the way, the negative memory was determined through the measurement of difference in concentration of image between a region where the residual toner was left remained and a region where the residual toner was not existed.

As shown in FIG. 11, as the quantity of residual toner was increased, the generation of negative memory was proportionally increased.

Since it is impossible to visually recognize a difference in concentration as long as the difference in concentration of image is confined to 0.01 or less, it will be recognized that the quantity of residual toner should preferably be confined to not more than 1.5% by weight.

Experiment 3

(1) A Combination of Toner B and Carrier α:

The Toner B was mixed with 95 parts by weight of ferrite carrier α at a mixing ratio of 5% by weight to prepare a developing agent. By making use of this developing agent, the distribution of adhesive force and the quantity of residual toner were measured in the same manner as described in Experiment 1. As a result, an average adhesive strength to the image carrier was $1.05\times10^{-7}$ (N) and 20% of this adhesive force was $2.1\times10^{-8}$ (N). The ratio of the developing agent having an adhesive force of not more than $2.1\times10^{-8}$ (N) was 7% by weight.

Further, there was prepared an image forming apparatus having the same structure as that of FIG. 5 except that an intermediate transferring body was substituted for the transferring member and that the recording medium was not fed thereto. The aforementioned developing agent was applied to this image forming apparatus to perform the electrification, exposure and development of toner. Then, the ratio of dust around the developing agent image on the photoreceptor and around the image that had been transferred to the intermediate transferring body was respectively measured. In this case, a line image of 1.5 μm/pixel, 1200 pixel length=1.8 mm was taken up as an electronic data by making use of a CCD camera. Thereafter, the data was binarized to measure the length of trace line of the edge portion thereof and the ratio thereof to the length of straight line was calculated. As the scattering of toner around an image is increased, the length of trace line is caused to increase, thereby increasing the ratio thereof to the length of straight line.

The ratio of this trace line was 1.20 on the image of toner on the photoreceptor, but was 1.27 on the intermediate transferring body, thus indicating only a slight magnitude of deterioration in transcription and hence indicating a satisfactory level of transcription.

(2) A Combination of Toner C and Carrier β:

11 parts by weight of Toner C was mixed with 89 parts by weight of Carrier β to obtain a developing agent. As a result, an average adhesive strength to the image carrier was $1.035\times10^{-7}$ (N) and hence the ratio of the developing agent having an adhesive force of not more than $2.07\times10^{-8}$ (N), i.e. 20% of this average adhesive force in the distribution, was 10% by weight.

By making use of this developing agent, the ratio of dust around an image was measured in the same manner as described above.

As a result, the ratio of this trace line was 1.20 on the photoreceptor, but was 1.33 on the intermediate transferring body, thus indicating only a slight magnitude of deterioration in transcription and hence also indicating a satisfactory level of transcription.

Figure 12:
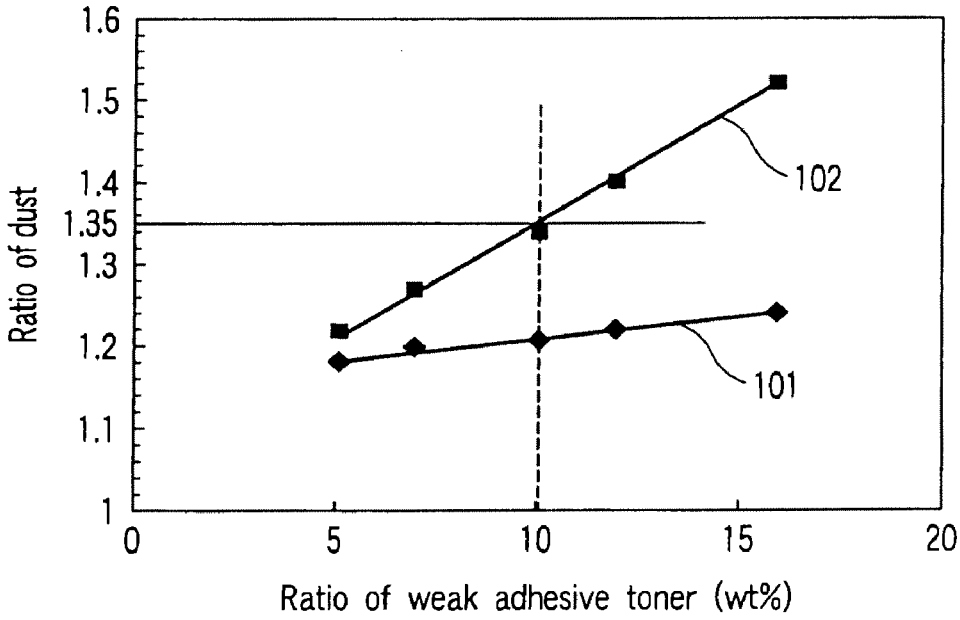
FIG. 12 is a graph illustrating the relationship between the ratio of developing agent having a weak adhesive force and the ratio of dust.

FIG. 12 shows a graph illustrating the relationship between the ratio of developing agent having a weak adhesive force, i.e. 20% of the average adhesive force and the ratio of dust of toner that can be derived from the ratio of this trace line before and after the transfer of toner.

In FIG. 12, reference number 101 represents the ratio of dust on the photoreceptor, and 102 the ratio of dust on the intermediate transferring body.

As shown in FIG. 12, it will be clear that as the ratio of developing agent having an adhesive force of as weak as 20% of the average adhesive force is increased, the ratio of dust is badly increased.

It has been found out that even if a sharp image which is extremely small in quantity of dust, i.e. as small as about 1.2, is formed on a photoreceptor, the degree of dispersion of developing agent or the degree of losing sharpness of image that may be caused due to the transcription is much interrelated with the ratio of developing agent having a weak adhesive force. As long as the ratio of dust on the intermediate transferring body can be limited to around 1.35, even if the developing agent is transferred to paper, the increase of dust can be confined within a permissible range. Thus, by limiting the quantity of toner having an adhesive force of as weak as 20% of the average adhesive force to not more than 10%, it was possible to obtain a sharp image which was minimal in scattering of toner.

Experiment 4

11 parts by weight of Toner D was mixed with 89 parts by weight of Carrier β to prepare a developing agent.

By making use of this developing agent, a distribution of the adhesive force of toner to a photoreceptor was measured in the same manner as in Experiment 1. As a result, an average adhesive strength to the photoreceptor was $1.04\times10^{-7}$ (N) and the ratio of the developing agent having an adhesive force of not more than $2.1\times10^{-8}$ (N), i.e. 20% of this average adhesive force in the distribution, was 5% by weight.

This developing agent was mounted on a first image forming unit of the same color image forming apparatus as shown in FIG. 8 and the magnitude of reverse transcription of the developing agent to a second image forming unit was measured under a transferring condition where the quantity of residual toner became 1.2%. As a result, the magnitude of reverse transcription was found 1.8% by weight.

It has been found out through experiments that assuming a situation where the printing ratio of the color of a first developing agent four times as large as the printing ration of the color of a second developing agent, i.e. where the quantity of developing agent to be discharged by the printing is very small as compared with the quantity of developing agent to be intermingled through reverse transferring of developing agent, as long as the quantity of reverse transcription can be limited to 2% by weight under the conditions where the color of the first developing agent is yellow and the color of the second developing agent is cyan, the change in color difference due to color mixture can be confined within the range of not more than 10. Therefore, the value of 1.8% by weight in magnitude of reverse transcription can be considered as falling within a permissible range.

This condition of simulation was formulated as a result of studies on the conditions which are considered most severe for the color mixture and the fluctuation of color in the employment of printing apparatus in various manners.

Figure 13:
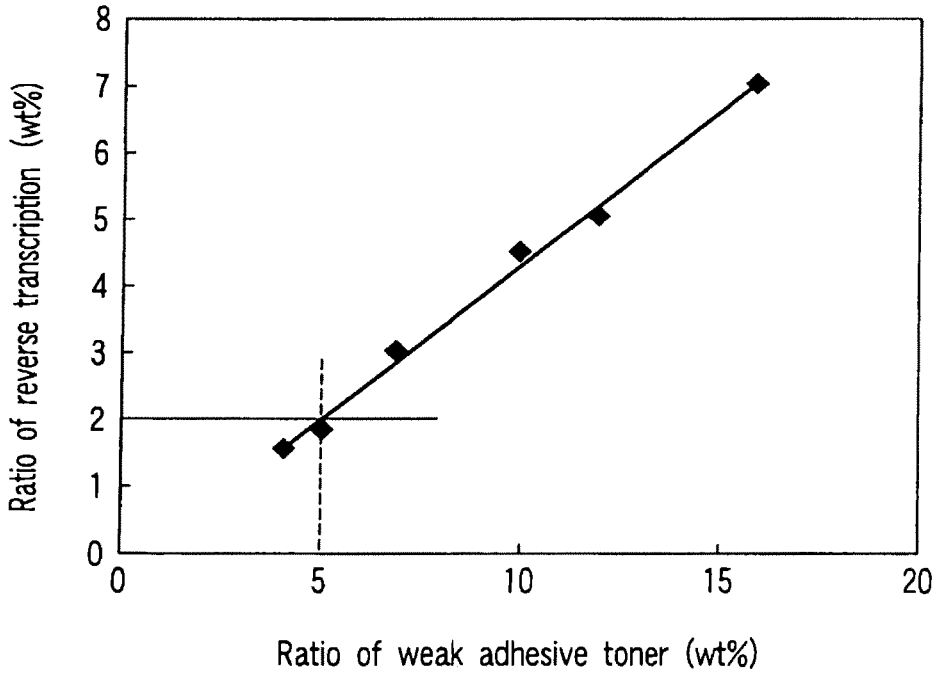
FIG. 13 is a graph illustrating the relationship between the ratio of developing agent having a weak adhesive force and the quantity of reverse transferring of developing agent.

When the ratio of a developing agent having an adhesive force of as weak as 20% of the average adhesive force and the quantity of reverse transcription were measured using various kinds of developing agent, the results as shown in FIG. 13 was obtained.

Thus, FIG. 13 shows a graph illustrating the relationship between the ratio of developing agent having a weak adhesive force and the quantity of reverse transferring of developing agent.

As shown in FIG. 13, it was recognized that as the ratio of developing agent having a weak adhesive force was increased, the quantity of reverse transcription was proportionally increased.

Based on the results of study made by the present inventors that as long as the quantity of reverse transcription is confined to not more than 2% by weight, the fluctuation of color due to color mixture can be controlled within a permissible range, it is only required to control the ratio of developing agent having a weak adhesive force to 5% or less.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a developing portion for feeding a developing agent to a static latent image formed on an image carrier to enable the developing agent to adhere to the surface of an image carrier to form a developing agent image; and a transferring portion for transferring the developing agent image to a recording material;

and the developing agent has a volume average particle size of 4 to 7 μm, and the ratio of the developing agent having an adhesive force which is not less than 2.5 times as high as an average value of a distribution of adhesive force is 3% by weight or less based on an entire weight of the developing agent in a distribution of adhesive force to the surface of the image carrier.

2. The image forming apparatus according to claim 1, wherein the ratio of the developing agent having an adhesive force of not more than 20% of an average value of the distribution of adhesive force is 10% by weight or less based on an entire weight of the developing agent.

3. The image forming apparatus according to claim 1, the developing agent is formed by a grinding method.

4. The image forming apparatus according to claim 1, the average value of a distribution of adhesive force between the toner and the photoreceptor is determined from the calculation wherein the centrifugal force acted on the developing agent at each rotational speed F =RCF×m . . . (2) is multiplied by the ratio of the toner that has been separated at each rotational speed and all of the resultant values are added together when the centrifugal acceleration (RCF), and the centrifugal force acting on the toner when the weight of a single particle of toner is defined as m can be expressed as follows:

$$RCF=1.118\times10^{-5}\times r\times N^2\times g \quad (1)$$

r:Distance between the set position of sample and the rotational center $N^2$:Rotational speed (rpm)

g:Gravitational acceleration $$F=RCF\times m \quad (2)$$

$$m=(4/3)\pi\times r^3\times\rho \quad (3)$$

r:Diameter (assumed as spherical)

ρ:Specific gravity of toner.

5. An image forming apparatus comprising:

a developing portion for feeding a developing agent to a static latent image formed on the image carrier to enable the developing agent to adhere to the surface of an image carrier to form a developing agent image; and a transferring portion for transferring the developing agent image to a recording material;

and the developing agent has a volume average particle size of 4 to 7 μm, and the ratio of the developing agent having an adhesive force of not more than 20% of an average value of a distribution of adhesive force is 10% by weight or less based on an entire weight of the developing agent in a distribution of adhesive force to the surface of the image carrier.

6. The image forming apparatus according to claim 5, wherein the developing portion is further provided with a mechanism for recovering a residual toner remaining on the surface of the image carrier concurrent with the development of image; and in a distribution of adhesive force to the surface of the image carrier, the ratio of the developing agent having an adhesive force which is not less than 2.5 times as high as an average value of a distribution of adhesive force is 1.5% by weight or less based on an entire weight of the developing agent.

7. A color image forming apparatus comprising:

two or more developing portions for feeding plural kinds, differing in color, of developing agent to static latent images formed on the image carriers respectively to enable the developing agent to adhere to the surface of each of image carriers to form developing agent images differing in color; and transferring portions for transferring the developing agent images differing in color to a recording material;

and the developing agent has a volume average particle size of 4 to 7 μm, and a distribution of adhesive force to the surface of the image carrier, which is configured such that the ratio of the developing agent having an adhesive force of not more than 20% of an average value of a distribution of adhesive force is 5% by weight or less based on an entire weight of the developing agent.

8. The color image forming apparatus according to claim 7, wherein the ratio of the developing agent having an adhesive force which is not less than 2.5 times as high as an average value of a distribution of adhesive force is 3% by weight or less based on an entire weight of the developing agent in a distribution of adhesive force to the surface of the image carrier.

9. The color image forming apparatus according to claim 7, the developing agent is formed by a grinding method.

10. The color image forming apparatus according to claim 7, the average value of a distribution of adhesive force between the developing agent and the photoreceptor is determined from the calculation wherein the centrifugal force acted on the toner at each rotational speed F=RCF×m . . . (2) is multiplied by the ratio of the toner that has been separated at each rotational speed and all of the resultant values are added together when the centrifugal acceleration (RCF), and the centrifugal force acting on the toner when the weight of a single particle of toner is defined as m can be expressed as follows:

$$RCF=1.118\times10^{-5}\times r\times N^2\times g \quad (1)$$

r:Distance between the set position of sample and the rotational center $N^2$:Rotational speed (rpm)

g:Gravitational acceleration $$F=RCF\times m \quad (2)$$

$$m=(4/3)\pi\times r^3\times\rho \quad (3)$$

r:Diameter (assumed as spherical)

ρ:Specific gravity of toner.

* * * * *